US007578112B2

(12) United States Patent
Korten et al.

(10) Patent No.: US 7,578,112 B2
(45) Date of Patent: Aug. 25, 2009

(54) METHOD FOR PACKAGING PRODUCTS AS WELL AS SUCH A DEVICE

(75) Inventors: Hubertus Andreas Henricus Korten, Weert (NL); Petrus Josef Franciscus Slenders, Maarheeze (NL)

(73) Assignee: Robert Bosch Verpakkingsmachines B.V., Weert (NL)

( * ) Notice: Subject to any disclaimer, the term of this patent is extended or adjusted under 35 U.S.C. 154(b) by 0 days.

(21) Appl. No.: 11/408,807

(22) Filed: Apr. 20, 2006

(65) Prior Publication Data

US 2007/0084147 A1 Apr. 19, 2007

(30) Foreign Application Priority Data

Apr. 20, 2005 (NL) ..... 1028819

(51) Int. Cl.
*B65B 5/10* (2006.01)

(52) U.S. Cl. ..... 53/443; 53/147; 53/244; 53/250

(58) Field of Classification Search ..... 53/443, 53/543, 531, 255, 259–262, 147, 244, 250
See application file for complete search history.

(56) References Cited

U.S. PATENT DOCUMENTS

| | | | | | |
|---|---|---|---|---|---|
| 2,697,541 | A * | 12/1954 | Patterson et al. | ..... | 53/513 |
| 3,983,682 | A | 10/1976 | Scully | ..... | 53/126 |
| 4,027,459 | A * | 6/1977 | Nieskens et al. | ..... | 53/500 |
| 4,081,943 | A | 4/1978 | Leasure et al. | ..... | 53/26 |
| 4,398,383 | A * | 8/1983 | Prakken | ..... | 53/537 |
| 4,524,566 | A | 6/1985 | Hauers et al. | ..... | 55/534 |
| 4,864,801 | A | 9/1989 | Fallas | ..... | 53/446 |
| 4,979,353 | A | 12/1990 | Seppala | ..... | 53/449 |
| 5,588,285 | A * | 12/1996 | Odenthal | ..... | 53/534 |
| 5,813,196 | A * | 9/1998 | Page et al. | ..... | 53/448 |
| 6,357,210 | B1 * | 3/2002 | Wetter | ..... | 53/436 |
| 6,694,706 | B1 | 2/2004 | Odenthal et al. | ..... | 53/443 |
| 2003/0140601 | A1 * | 7/2003 | Prakken | ..... | 53/434 |

FOREIGN PATENT DOCUMENTS

| | | |
|---|---|---|
| DE | 44 47 050 A1 | 10/1976 |
| GB | 2 061 219 A | 5/1981 |
| WO | 2004/000649 A | 12/2003 |

* cited by examiner

*Primary Examiner*—Thanh K Truong
(74) *Attorney, Agent, or Firm*—Ladas & Parry LLP

(57) ABSTRACT

In a method for packaging products at least one product to be packaged is placed in a bag by means of a bag filling device, after which a number of bags are placed in a box. The placing of the products in bags is synchronised with the placing of the bags in boxes and also the placing of the boxes in a direction of conveyance.

12 Claims, 4 Drawing Sheets

METHOD FOR PACKAGING PRODUCTS AS WELL AS SUCH A DEVICE

Figure 1:
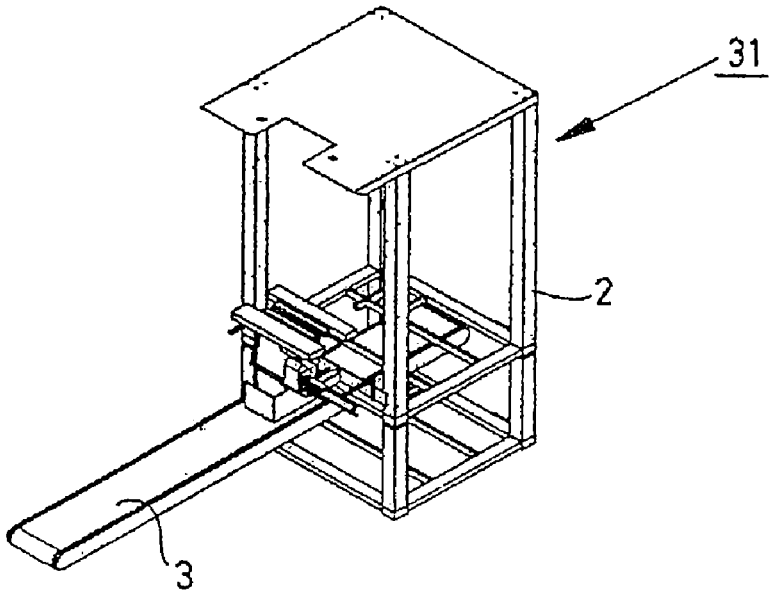

The invention relates to a method for packaging products, in which at least one product to be packaged is placed in a bag by means of a bag filling device, after which a number of bags are placed in a box conveyed by means of a box conveyor device, the placing of the products in bags being synchronised with the placing of the bags in boxes and also with the movement of the boxes in a direction of conveyance.

The invention also relates to a device suitable for carrying out such a method.

In such a device and method known from U.S. Pat. No. 3,983,682 a bag filling device is used to form a bag from, for example, a plastic film, in which bag the product to be packaged is subsequently placed. The bag is then sealed and the product is packaged. The bag is subsequently placed in a box standing ready below the bag filling device.

The synchronisation makes it possible to place the filled bags in the boxes immediately after the products have been packaged in bags. This ensures that the orientation of the bag is retained, the risk of damage to the products present in the bags is low, and the products are quickly packaged in bags and subsequently in boxes.

A drawback of such a known method is, however, that if the film tears and/or seams are not made properly in the film, the product to be placed in the tubular film will pass through the bag filling device and into the box standing ready below the bag filling device. This will mean that the box has to be cleaned or discarded, which will constitute an undesirable interruption in the production process.

The object of the invention is to provide a more efficient method by which products can be packaged and subsequently placed in boxes.

This object is achieved by the method according to the invention in that the box is in a position staggered relative to a bag feed-through opening of the bag filling device, while a buffer device is positioned between the bag filling device and the box conveyor device for the purpose of moving a filled bag from a position below the bag feed-through opening to a position above the box.

Owing to the fact that the box is in a staggered position relative to the bag feed-through opening of the bag filling device, if the film tears or seams in the film come undone, the product to be placed in the tubular film will fall through the bag feed-through opening onto the ground, where it can be cleared away at a suitable time. The product does not accidentally reach the box in loose form. Owing to the fact that the bag is placed in the box directly after it has been filled and sealed, the orientation of the bag is retained, which is advantageous for placing the bag in the box. Furthermore, this avoids the risk of damage to the bags, and the bags are quickly placed in the boxes.

One embodiment of the method according to the invention is characterised in that the bag filling device releases a bag only if a box is available for receiving the bag.

In this way a bag is prevented from leaving the bag filling device without a box in which the bag is to be placed being available.

Yet another embodiment of the method according to the invention is characterised in that the box is moved in a direction of conveyance depending on the supply of bags from the bag filling device.

If, for example, a stoppage occurs in the bag filling device, only a full box will be conveyed further in the direction of conveyance. A box that is not yet full will remain near the bag filling device. Only when bags have been placed from the bag filling device in the box again and the box has been filled as desired will the box be conveyed further in the direction of conveyance and discharged.

Another embodiment of the method according to the invention is characterised in that the bag filling device is provided with a guide, by means of which a bag is guided into the box.

The bag filled and preferably also sealed in the bag filling device is guided into the box by means of the guide. This means that the bag is positioned in a controlled manner in a desired place in the box. In this way it is ensured that, for example, the bag does not fall over, thus making it difficult or completely impossible to place the next bag.

Yet another embodiment of the method according to the invention is characterised in that the guide extends into the box, the bag to be placed in the box being placed in a space in the box which, viewed in the direction of conveyance, is in front of the guide.

It is possible in this way to dimension the space present in the box in such a way that the bag is a virtually exact fit in it. This means that the bag is positioned accurately in the desired place in the box, so that it is possible to place the desired number of bags in the box.

Yet another embodiment of the method according to the invention is characterised in that the guide is provided with a bag pressure part which extends into the box, the box being moved relative to the bag pressure part in order to press in the bag placed in the box.

By pressing in the bags it is ensured that sufficient space is present in the box for placing the desired number of bags in the box, so that a relatively high degree of filling can be achieved. Furthermore, in this way the bag is pressed against the wall of the box or against bags placed earlier in the box, so that the bags stand firmly in the box. This means that the risk of the bag falling over during movement of the box in the direction of conveyance will be minimal. It is undesirable for the bag to fall over because this makes it difficult to place following bags in the box.

Another embodiment of the method according to the invention is characterised in that the box is moved in a direction opposite to the direction of conveyance in order to press in the bag in the box.

By moving the box in a direction opposite to the direction of conveyance, the space between a bag placed in the box earlier or a wall of the box, on the one hand, and the bag pressure part, on the other hand, is reduced, so that the bag is pressed in.

The movement of the box in or opposite to the direction of conveyance is synchronised with the packaging of the products in bags.

Yet another embodiment of the method according to the invention is characterised in that the bag pressure part is moved in the direction of conveyance in order to press in the bag in the box.

This means that the box need only be movable in the direction of conveyance and it is possible to press in the bag in any desired way by means of a separately driven bag pressure part.

Yet another embodiment of the method according to the invention is characterised in that after the bag has been pressed in, the box is moved relative to the guide in order to create space for placing the next bag.

Pressing in the bag will ensure that it retains the desired position in the box. By subsequently moving the box, space is easily created for placing the next bag.

Yet another embodiment of the method according to the invention is characterised in that the guide is removed from the box before the last bag is placed in the box.

Guiding the bag until just above the box is all that is necessary for placing the last bag in the box. The rear wall of the box, viewed in the direction of conveyance, and the bag placed just in front of it form a further guide for the last bag to be placed in the box.

Yet another embodiment of the method according to the invention is characterised in that after the last bag has been placed in the box, the box is moved in the direction of conveyance, while the next box is positioned near the bag filling device and the guide is placed in said next box.

All these operations need to be carried out in the period in which a new bag is being prepared, by means of the bag filling device, for placing in the box. This means that by means of the bag filling device, products can be placed in bags at a virtually constant speed, and these bags can then be placed in boxes.

Yet another embodiment of the method according to the invention is characterised in that a number of bags are first collected in the buffer device, after which the bags are placed simultaneously in the box.

In this way a number of bags that are, for example, side by side, viewed in the direction of conveyance, can be placed in the box simultaneously. This makes it possible to form a number of rows of bags in the box simultaneously.

Yet another embodiment of the method according to the invention is characterised in that the bags are pressed in simultaneously after being placed in the box.

In this way a number of bags that are, for example, side by side can be pressed in together, so that all bags standing side by side in a row are pressed in the same way.

The invention also relates to a device which is suitable for carrying out the method described above.

The device according to the invention is characterised in that the device is provided with a bag filling device, a box conveyor device, and a controller for synchronising the placing of the products in bags, the placing of the bags in boxes and the movement of the boxes in a direction of conveyance.

Good synchronisation can be achieved by means of the controller, making it possible in an efficient manner for products to be packaged in bags and for the products packaged in bags subsequently to be placed in a box.

Figure 2:
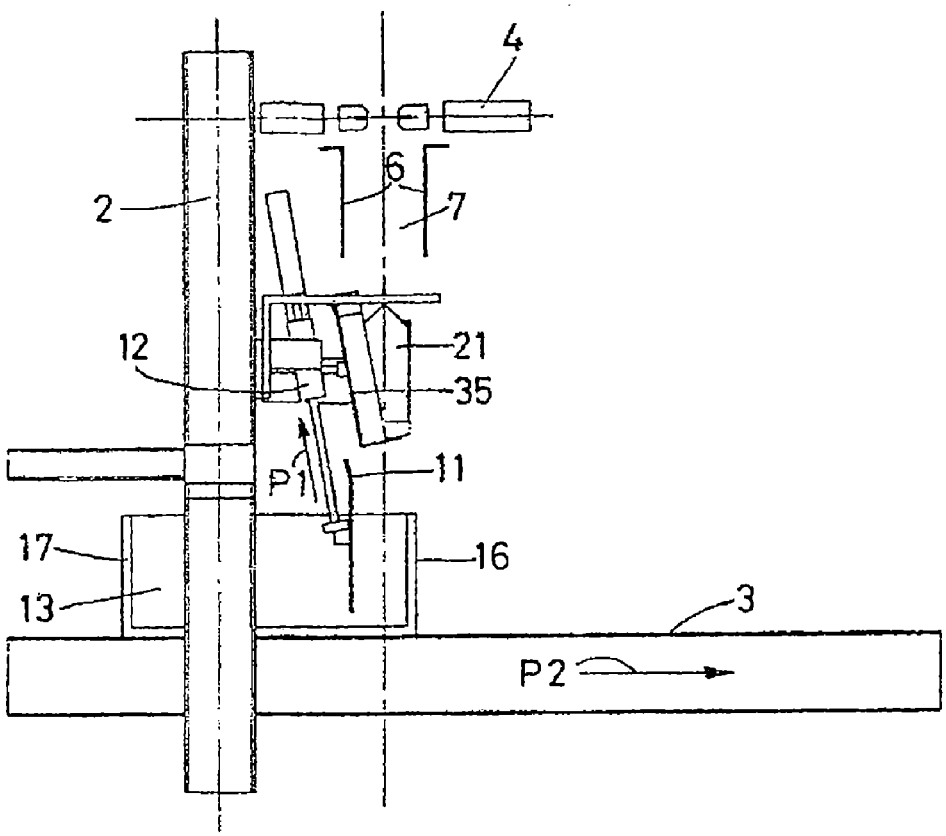
Figure 3:
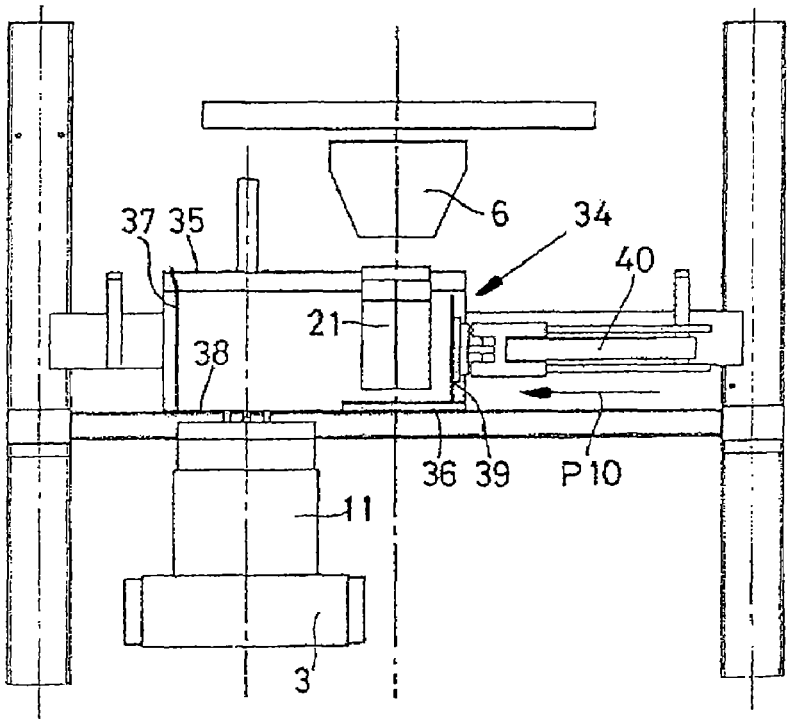
Figure 4:
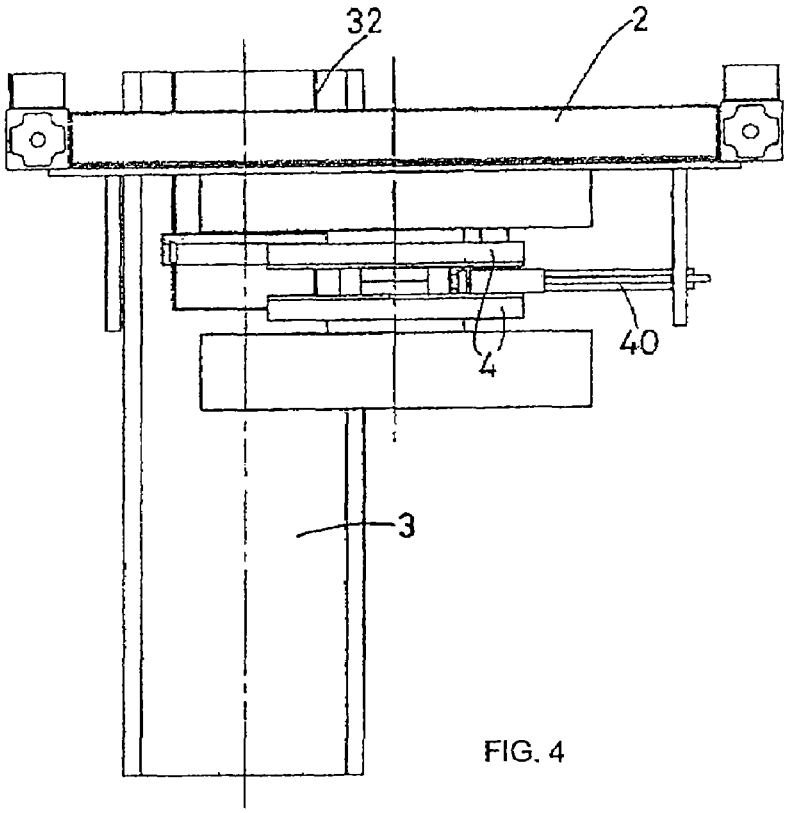
Figure 5:
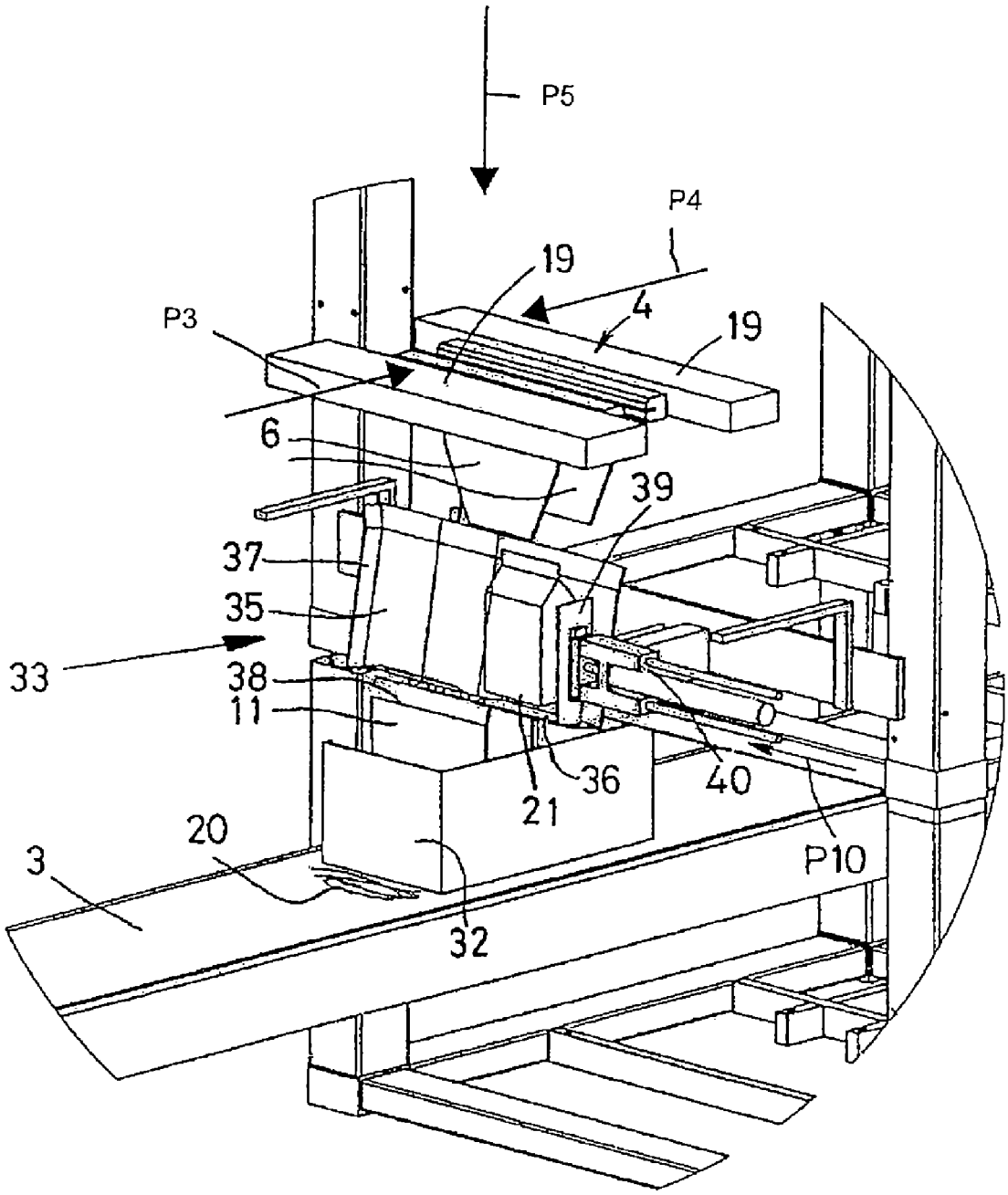
Figure 6:
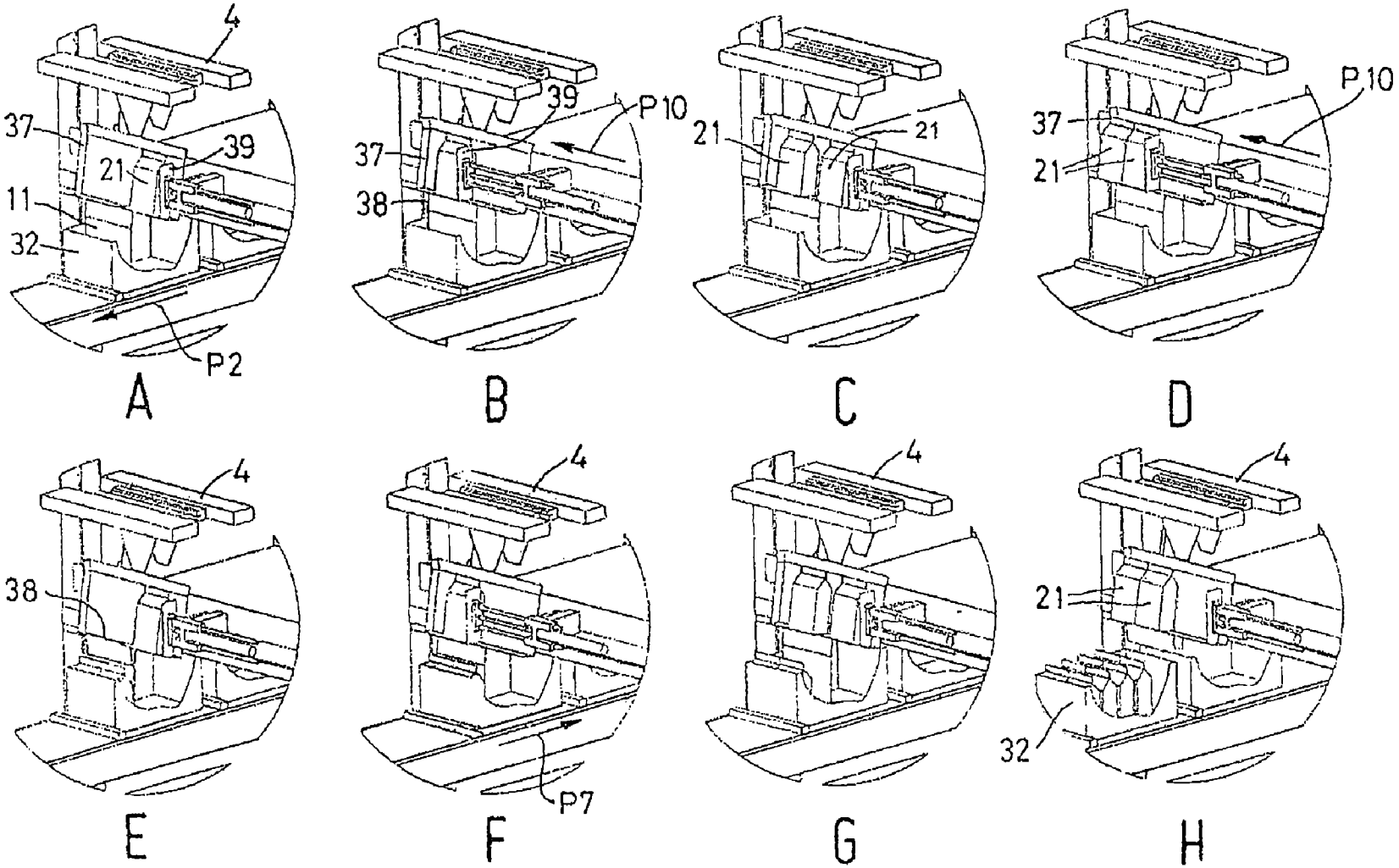

The invention will now be explained in greater detail with reference to the drawings, in which:

FIG. 1 is a perspective view of an embodiment of a device according to the invention, FIGS. 2-4 are a side view, front view and top view of the device shown in FIG. 1, FIG. 5 is a perspective view of a detail of the device shown in FIG. 1, FIGS. 6A-H show stepwise the method according to the invention of the device shown in FIGS. 1-5.

Corresponding parts are provided with the same reference numeral in the figures.

FIG. 1 to FIGS. 6A-H show an embodiment of a device 31 according to the invention. The device 31 is suitable for placing a number of bags 21 standing side by side in a row simultaneously in a box 32. The device 31 is provided with a frame 2 and with an endless conveyor belt 3 extending transversely through the frame 2. The frame 2 supports a bag forming, filling and sealing device which is known per se, and only the sealing part 4 of which is visible. Between the sealing part 4 and the conveyor belt 3 the device 31 is provided with a guide 33, which is provided with two plates 6 extending parallel to each other and with a feed-through opening 7 situated between said plates. The guide 33 is further provided with a pressure plate 11, which can be moved in and opposite to the direction indicated by the arrow P1 by means of a piston-cylinder combination 12. The pressure plate 11 is of a width which is substantially the same as the width of two bags. As is clearly visible in FIG. 3 and FIG. 4, the pressure plate 11 is in a staggered position relative to the guide plate 6. The advantage of this is that if the tubular film tears and/or a transverse seam is not properly made in the film, the product to be introduced into the tubular film will fall through between the jaws 19 of the sealing part 4 onto the ground and cannot accidentally pass in loose form into the box 32. Between the plates 6 and the pressure plate 11 the guide 33 is provided with a buffer device 34. The buffer device 34 comprises a bearing plate 35, which on a side facing away from the plates 6 is provided with a receiving plate 36, on which a bag 21 falling through between the plates 6 is received. On a side situated near the pressure plate 11 the bearing plate 35 is further provided with a vertically extending stop edge 37. Between the stop edge 37 and the receiving plate 36 the bearing plate 35 is provided with a flap 38. The buffer device 34 is further provided with a push plate 39, which is movable by means of a piston-cylinder combination 40 in and opposite to the direction indicated by the arrow P10.

The endless conveyor belt 3 is movable in and opposite to the direction of conveyance indicated by the arrow P2, for the conveyance of boxes 32 lying on the conveyor belt 3. Each box 32 comprises at least an underside 14, two side walls 15 extending transversely to the underside, a front wall 16, viewed in the direction of conveyance P2, and a rear wall 17, viewed in the direction of conveyance.

The sealing device 4 comprises two jaws 19, which are positioned opposite each other and are movable towards and away from each other in and opposite to the directions indicated by the arrows P3, P4. A double-folded endless film (not shown) is guided between the jaws 19 in the direction indicated by the arrow P5, in the course of which a transverse seam is made in the film by means of the jaws 19. The products to be packaged are then placed in the tubular film, which is sealed on the underside by the transverse seam. In the meantime or subsequently, tubular film is moved further in the direction indicated by the arrow P5, after which a transverse seam is made in the tubular film again by means of jaws 19, and the bag thus formed is cut off.

The method described above is known per se and will therefore not be explained in any further detail.

The operation of the device 31 will now be explained in greater detail with reference to FIGS. 6A-H. At the starting position shown in FIG. 6A a box 32 is situated between two stops 20 provided on the conveyor belt 3. The pressure plate 11 has been positioned in the box 32 by means of piston-cylinder combination 12, whereby a space for two bags 21 standing side by side being present between the front side of the box 32 and the plate 11. By way of the sealing part 4 a bag 21 has fallen onto the receiving plate 36. The pusher plate 39 is in the position furthest away from the stop plate 37. The pusher plate 39 is then moved by means of the piston-cylinder combination in the direction indicated by the arrow P10, the bag 21 likewise being moved in the direction indicated by the arrow P10 by means of the pusher plate 39. The bag 21 is supported on the underside here by the closed flap 38 (see FIG. 6B). The pusher plate 39 is subsequently taken back to the position shown in FIG. 6A, after which the next bag 21 can be deposited by way of the sealing part 4 onto the receiving plate 36 (FIG. 6C). This bag 21 is also pushed again by means of the pusher plate 39 in the direction indicated by the arrow P10. The bag 21 also pushes the bag 21 positioned earlier on the flap 38 further in the direction indicated by the arrow P10. The stroke of the pusher plate 39 is set here in such a way that in the outermost position of the pusher plate 39 shown in FIG. 6D the bags 21 on one side are resting firmly against the stop plate 37 and on the other side are resting firmly against the pusher plate 39. The pusher plate 39 is then moved again in the direction opposite to that of the arrow P10, after which the flap 38 is opened and the two bags 21 fall simultaneously into the space bounded by the pressure plate 11 and the front side of the box 32 (FIG. 6E).

Then the conveyor belt 3 is moved in a direction opposite to the direction of conveyance as indicated by the arrow P7, causing the wall 16 of the box 32 to be moved towards the pressure plate 11 and the bag 21 to be pressed firmly against the front wall 16. Then the box 13 is moved in the direction of the conveyance indicated by the arrow P2 again by means of the conveyor belt 3 until a space 22 sufficiently large for receiving a next bag 21 is present between the bag 21 that is already present and the pressure plate 11. (FIG. 6G). At the same time new bags 21 are formed and received on the receiving plate 36 in the manner described with reference to FIGS. 6A-6D, and are taken to a position above the flap 38, after which the next row of two bags 21 is positioned in the box 32.

Prior to placing of the last two bags 21 in the box 32, the pressure plate 11 is lifted out of the box 32 by means of the piston-cylinder combination 12 in the direction indicated by the arrow P1.

Then the last bag 21 is placed in the space bounded by the last bag but one and the rear wall 17. Following that, the conveyer belt 3 is moved in the direction indicated by the arrow P2 until a next box 32 takes up the position that is shown in FIG. 6A. The pressure plate 11 is then moved into the box 32 in the direction opposite to the direction of the arrow P1, after which this box, too, can be filled with bags 21 in the manner described above.

By means of the controller, the drive of the sealing part 4, the movement of the pressure plate 39, the opening and closing of the flap 38 and also the conveyance of the box 32 in the direction indicted by the arrow P2 and in the direction opposite to the arrow P2, indicated by the arrow P7, is controlled in such a way that bags can be filled and sealed and subsequently placed in boxes at maximum speed.

The forming, filling and sealing of the bags and likewise the box filling process are controlled from a central control unit, so that an operator does not have to duplicate any input of values. If a fault occurs in the box filling process, the bag filling machine is temporarily stopped, and if a fault occurs in the bag filling machine, the box is held in the correct standby position.

It is, of course, also possible to place a single bag or more than two bags side by side in a box.

It is also possible to use friction wheels or driven rollers to reduce the speed of the falling bag 21. It is also possible to provide the pressure plate 11 with a spring-loaded mechanism which remains in contact with a bag 21 already placed until the next bag 21 is placed in a box.

It is also possible to make the conveyor belt 3 extend in a slightly slanting position, so that under the influence of gravity the bags already placed in the box automatically rest against the bags placed earlier, or against the wall of the box.

It is also possible to arrange for the pressing in with the pressure plate 11 to be achieved by moving the pressure plate 11 towards the front wall.

Products which can be packaged are bulk products such as coffee, flour or a liquid, or general goods such as coffee pads, confectionery or cakes.

REFERENCE NUMERALS frame 2
conveyor belt 3
sealing part 4
plate 6
feed-through opening 7
pressure plate 11
piston-cylinder combination 12
underside 14
side wall 15
front wall 16
rear wall 17
jaws 19
stop 20
bag 21
device 31
box 32
guide 33
buffer device 34
bearing plate 35
receiving plate 36
stop edge 37
flap 38
pusher plate 39
piston-cylinder combination 40
arrow P1-P5, P7, P10

The invention claimed is:

1. A method for packaging products, in which at least one product to be packaged is placed in a bag by means of a bag filling device, after which a number of bags are placed in a box conveyed by means of a box conveyor device, the placing of the products in bags being synchronised with the placing of the bags in boxes and with also the movement of the boxes in a direction of conveyance, the box is in a position staggered relative to a bag feed-through opening of the bag filling device, while a buffer device is positioned between the bag filling device and the box conveyor device for the purpose of moving a filled bag from a position below the bag feed-through opening to a position above the box, the bag filling device is provided with a guide, by means of which a bag falling from the position above the box is guided into the box, which guide is provided with a bag pressure part which extends into the box, the box being moved relative to the bag pressure part by means of the box conveyor device for a short distance in a direction opposite to the direction of conveyance in order to press the bag placed in the box against a wall of the box by means of the bag pressure part.

2. A method according to claim 1, characterised in that the bag filling device releases a bag only if a box is available for receiving the bag.

3. A method according to claim 1, characterised in that the box is moved in the direction of conveyance when a supply of bags from the bag filling device is available.

4. A method according to claim 1, characterised in that the bag pressure part is moved in the direction of conveyance in order to press the bag further against the wall of the box.

5. A method according to claim 1, characterised in that after the bag has been pressed against the wall of the box, the box is moved relative to the guide in order to create space for placing the next bag.

6. A method according to claim 1, characterised in that the guide is removed from the box before the last bag is placed in the box.

7. A method according to claim 1, characterised in that after the last bag has been placed in the box, the box is moved in the direction of conveyance, while the next box is positioned near the bag filling device and the guide is placed in said next box.

8. A method according to claim 1, characterised in that a number of bags are first collected in the buffer device, after which the bags are placed simultaneously in the box.

9. A method according to claim 8, characterised in that the bags are pressed simultaneously against the wall of the box after the bags have been placed in the box.

10. A method for packaging products wherein product to be packaged is placed in bags by a bag filling device having a bag feed-through opening below a location at which bags are filled and through which filled bags are released, wherein one or more filled bags are placed in a box conveyed by a box conveyor device, and wherein the placing of product in bags is synchronized with the placing of bags in boxes and with the movement of boxes in a direction of conveyance, comprising:

releasing a bag through the bag feed-through opening onto a position below the bag feed-through opening;

moving the bag from the position below the bag feed-through opening to a position above a box, the box in a position staggered relative to the bag feed-through opening;

releasing the bag to fall from the position above the box;

guiding the falling bag into a place in the box with a guide having a bag pressure part extending into the box; and moving the box relative to the bag pressure part by means of the box conveyor device for a short distance in a direction opposite to the direction of conveyance in order to press the bag placed in the box against a wall of the box by means of the bag pressure part.

11. The method of claim 10, wherein the bag is a first bag, and further comprising:

after the box is moved to press the first bag against the wall of the box, moving the box relative to the guide to create a space between the first bag and the guide;

releasing a second bag through the bag feed-through opening onto the position below the bag feed-through opening after the first bag is moved from the position below the bag feed-through opening;

moving the second bag from the position below the bag feed-through opening to the position above the box after the first bag is released from the position above the box;

releasing the second bag to fall from the position above the box after the space is created;

guiding the falling second bag into the created space with the guide;

moving the box relative to the bag pressure part by means of the box conveyor device for a short distance in a direction opposite to the direction of conveyance in order to press the placed second bag against the first bag by means of the bag pressure part.

12. The method of claim 10, wherein the bag is a first bag, and further comprising:

releasing a second bag through the bag feed-through opening onto the position below the bag feed-through opening after the first bag is moved from the position below the bag feed-through opening; and moving the second bag from the position below the bag feed-through opening to a position next to the first bag and above the box;

wherein the first and second bags are released together to fall into the box;

wherein the falling first and second bags are guided together into the box with the guide; and wherein the moving of the box relative to the bag pressure part by means of the box conveyor device for a short distance in a direction opposite to the direction of conveyance presses the first bag and the second bag against the wall of the box by means of the bag pressure part.

* * * * *